US011268318B2

(12) United States Patent
Dong et al.

(10) Patent No.: US 11,268,318 B2
(45) Date of Patent: Mar. 8, 2022

(54) FRAME FORMING STRUCTURE FOR USE WITH FRAME AND SASH OF ALUMINIUM-WOOD COMBINED DOOR/WINDOW

(71) Applicant: ZHEJIANG ROOMEYE ENERGY-SAVING TECHNOLOGY CO., LTD, Zhejiang (CN)

(72) Inventors: Chengming Dong, Huzhou (CN); Haihua Xu, Huzhou (CN); Chengjie He, Huzhou (CN)

(73) Assignee: ZHEJIANG ROOMEYE ENERGY-SAVING TECHNOLOGY CO., LTD, Huzhou (CN)

( * ) Notice: Subject to any disclaimer, the term of this patent is extended or adjusted under 35 U.S.C. 154(b) by 191 days.

(21) Appl. No.: 16/474,559

(22) PCT Filed: Mar. 30, 2018

(86) PCT No.: PCT/CN2018/081242
§ 371 (c)(1),
(2) Date: Jun. 28, 2019

(87) PCT Pub. No.: WO2018/177392
PCT Pub. Date: Oct. 4, 2018

(65) Prior Publication Data

US 2021/0293080 A1 Sep. 23, 2021

(30) Foreign Application Priority Data

Mar. 30, 2017 (CN) ..... 201710201278.9

(51) Int. Cl.
*E06B 3/98* (2006.01)
*E06B 3/96* (2006.01)
(Continued)

(52) U.S. Cl.
CPC ..... *E06B 3/9845* (2013.01); *E06B 3/982* (2013.01); *E06B 3/9885* (2013.01); *E06B 3/9646* (2013.01)

(58) Field of Classification Search
CPC .... E06B 2/9646; E06B 2/9845; E06B 2/9885; E06B 2/9608; E06B 2/964; E06B 2/9645; E06B 2/98; E06B 2/982
See application file for complete search history.

(56) References Cited

U.S. PATENT DOCUMENTS 1,335,554 A * 3/1920 Callahan ..... F16B 5/02 403/8
2,538,138 A * 1/1951 Webster ..... E06B 3/9646 52/657

(Continued)

FOREIGN PATENT DOCUMENTS

CA 2378669 A1 * 9/2003 ..... E06B 3/982
CH 610071 A5 * 3/1979 ..... E06B 3/982

(Continued)

*Primary Examiner* — Ryan D Kwiecinski
(74) *Attorney, Agent, or Firm* — Gang Yu

(57) ABSTRACT

Provided is a frame forming structure for use with a frame and a sash of an aluminium-wood combined door/window. The door/window may include at least a door/window frame or a door/window sash frame. The door/window frame or the door/window sash frame is formed by two connecting adjacent profile frame strips by means of an angle forming device and a round tenon rod on adjacent connecting end surfaces. Symmetric U-shaped notches for positioning the angle forming device and symmetric round tenon rod holes are processed on the connecting end surfaces of the two adjacent profile frame strips. A round tenon is used for positioning and inserted into the symmetric round tenon rod holes. A assembly-type the angle forming device is fixed the two adjacent profile frame strips. The disclosure has characteristics of increasing connecting strength of an angle (Continued)

portion and sealing performance after angle formation, improving convenience of frame formation.

4 Claims, 3 Drawing Sheets

(51) Int. Cl.
*E06B 3/984* (2006.01)
*E06B 3/988* (2006.01)
*E06B 3/964* (2006.01)

(56) References Cited

U.S. PATENT DOCUMENTS 3,673,674 A * 7/1972 Catulle ..... E06B 3/9646 29/464
3,928,100 A * 12/1975 Heuschen ..... E06B 3/9608 156/92
3,967,910 A * 7/1976 Tollefsrud ..... E06B 3/9725 403/402
3,992,840 A * 11/1976 Badat ..... B65D 7/12 52/285.2
4,076,438 A * 2/1978 Bos ..... E06B 3/982 403/297
4,275,972 A * 6/1981 Bowen ..... A47G 1/10 403/401
4,332,495 A * 6/1982 Burgers ..... A47G 1/102 403/6
5,090,835 A * 2/1992 Cox ..... F16B 12/24 403/294
5,934,819 A * 8/1999 Mangold ..... F16B 12/14 403/408.1
7,264,416 B2 * 9/2007 Kahl ..... F16B 7/18 403/187
9,217,278 B2 * 12/2015 Riley ..... E06B 3/9645
10,421,315 B2 * 9/2019 Roy ..... B25B 5/00
10,641,034 B2 * 5/2020 Dong ..... E06B 3/9845
10,669,773 B2 * 6/2020 Grube ..... E06B 9/52
10,837,226 B2 * 11/2020 Jeffries ..... E06B 3/982
10,851,582 B1 * 12/2020 Mitchell ..... E06B 3/984
2005/0235596 A1 * 10/2005 Pegorado ..... E06B 3/9646 52/656.9
2007/0297854 A1 * 12/2007 Ohrstrom ..... E05D 15/0682 403/401
2008/0072517 A1 * 3/2008 Grazioso ..... E06B 3/9646 52/698
2009/0241610 A1 * 10/2009 Watts ..... E06B 3/9688 70/91
2020/0032578 A1 * 1/2020 Parry ..... E06B 3/9645

FOREIGN PATENT DOCUMENTS

CN 202745641 U 2/2013
CN 103382802 A 11/2013
CN 203394291 U 1/2014
CN 103850597 A * 6/2014 ..... E06B 3/9648
CN 204782676 U 11/2015
CN 205349146 U 6/2016
CN 106869712 A 6/2017
CN 206513238 U 9/2017
CN 206681625 U 11/2017
CN 108894684 A * 11/2018
CN 109681093 A * 4/2019
DE 2800515 A1 * 7/1979 ..... E06B 3/9646
DE 29901235 U1 * 5/1999 ..... E06B 3/9845
DE 19954269 C1 * 4/2001 ..... E06B 3/9885
DE 20001250 U1 5/2001
DE 20211923 U1 * 12/2003 ..... E06B 3/9845
DE 202011050167 U1 * 8/2012 ..... E06B 3/9646
DE 202015005006 U1 * 8/2015 ..... E06B 3/982
DE 102014112308 A1 * 3/2016 ..... E06B 3/982
DE 102017120254 A1 * 3/2019 ..... E06B 3/964
DE 102018101285 A1 * 7/2019 ..... E06B 3/982
EP 0080019 A1 * 6/1983 ..... E06B 3/9845
EP 0652348 A2 * 5/1995 ..... E06B 3/9845
EP 1302349 A2 * 4/2003 ..... E06B 3/9646
EP 2011950 A2 1/2009
EP 3467249 A1 * 4/2019 ..... E06B 3/9646
FR 2586746 A1 * 3/1987 ..... E06B 3/982
FR 2761753 A1 * 10/1998 ..... E06B 3/982
GB 1457934 A * 12/1976 ..... E06B 3/964
GB 2072296 A * 9/1981 ..... E06B 3/982
GB 2150663 A * 7/1985 ..... E06B 3/982
GB 2569209 A * 6/2019 ..... E06B 3/9688
KR 100915507 B1 9/2009
WO WO-9214390 A1 * 9/1992 ..... A47G 1/102
WO WO-2004003326 A1 * 1/2004 ..... E06B 3/9646
WO WO-2014122181 A1 * 8/2014 ..... E06B 3/9646
WO WO-2015063690 A1 * 5/2015 ..... E06B 3/9845
WO WO-2019122925 A1 * 6/2019 ..... E06B 3/9885

* cited by examiner

FRAME FORMING STRUCTURE FOR USE WITH FRAME AND SASH OF ALUMINIUM-WOOD COMBINED DOOR/WINDOW

TECHNICAL FIELD

The disclosure relates to a frame forming structure of an aluminium-wood combined wood frame sash, and belongs to the field of building door/window technologies.

BACKGROUND

A frame forming way of a sash of a traditional aluminium-wood combined door/window is characterized in that an angle forming process of a round tenon rod and a dovetail tenon is taken when a formed angle of 45° is applied to an angle portion. A dovetail tenon groove is milled on wood, a plastic dovetail tenon is hammered and positioned with the round tenon rod, and an surface is gelatinized. However, an overall strength after angle formation is unsatisfactory because the dovetail tenon is prepared from nylon and due to its own structure, and as time goes on, part of connecting places may be trapped in untight sealing and other phenomena and accordingly trapped in water seepage, mildewing and other phenomena.

Technical Problems

In order to overcome disadvantages of the related technology, the disclosure provides a frame forming structure of an aluminium-wood combined wood frame sash, and the frame forming structure may increase connecting strength of an angle portion and sealing performance after angle formation while improving convenience of frame formation and increasing manufacturing efficiency.

Technical Solutions

An objective of the disclosure is completed by the following technical solutions of some embodiments: a frame forming structure for use with a frame and a sash of an aluminium-wood combined door/window is characterized in that the door/window includes at least a door/window frame or a door/window sash frame. The door/window frame or the door/window sash frame is formed by two connecting adjacent profile frame strips by means of an angle forming device and a round tenon rod on adjacent connecting end surfaces. The connecting end surfaces of two adjacent profile frame strips are processed to have a section at an angle of 0-60° with respect to an end plane of a normal profile frame strip respectively, and are interconnected to form a perpendicular frame edge. Symmetric U-shaped notches for positioning the angle forming device and symmetric round tenon rod holes are processed on the connecting end surfaces of the two adjacent profile frame strips, respectively. A round tenon rod, which is used for positioning, is inserted into the symmetric round tenon rod holes. When the two adjacent profile frame strips are mutually spliced, a space which accommodates assembly-type the angle forming device is formed at a splicing location. The Assembly-type the angle forming device is formed by combining two halves of the angle forming device, and each half of the two halves of the angle forming device is corresponding fixed in each of the U-shaped notches of positioning adjacent profile frame strips with a bolt. The two halves of the angle forming device are mechanically tightened by means of a bevel gear pair mechanism which is meshed through pairing, to tightly fix and connect the two adjacent profile frame strips.

In an exemplary embodiment, the angle forming device is formed by combining the two halves of the angle forming device, a positioning pin, a cover plate, a bevel gear pair of the angle forming device. The two halves of the angle forming device is a fixing substrate having two fixing holes and a gear hole. A side of one half of the angle forming device is provided with one gear hole and a cover plate connecting with the one half of the angle forming device as well. The positioning pin is a hollow cylindrical fastener, and both ends of the positioning pin are connected into the fixing holes which are arranged on opposite end surfaces of the two halves of the angle forming device. The bevel gear pair of the angle forming device is formed by meshing a bevel gear and a perpendicular bevel gear, the bevel gear is positioned between two positioning pins and has a screw, the perpendicular bevel gear is perpendicularly arranged in the gear hole and has a rotating head.

In an exemplary embodiment, a layer of single-component glue is processed in the U-shaped notches of two adjacent profile frame strips, respectively. A bottom of each of the U-shaped notches is provided with two pre-drilling holes, and the two halves of the angle forming device are fixed in the U-shaped notches when nailed through the two pre-drilling holes with the bolt, respectively. The connecting end surfaces of the two adjacent profile frame strips are processed into a section at an angle of 45° respectively, and each of the U-shaped notches is positioned on a middle end surface of the section at an angle of 45°.

Beneficial Effects

The disclosure positions with a round tenon rod and a positioning pin of an angle forming device and tightens with a bevel gear, thereby effectively ensuring connecting strength of an angle portion and sealing performance after angle formation and guaranteeing flatness. Furthermore, the disclosure has characteristics of increasing the connecting strength of the angle portion and the sealing performance after the angle formation, increasing convenience of frame formation, improving manufacturing efficiency, and the like.

DETAILED DESCRIPTION OF THE PREFERRED EMBODIMENT

Figure 1:
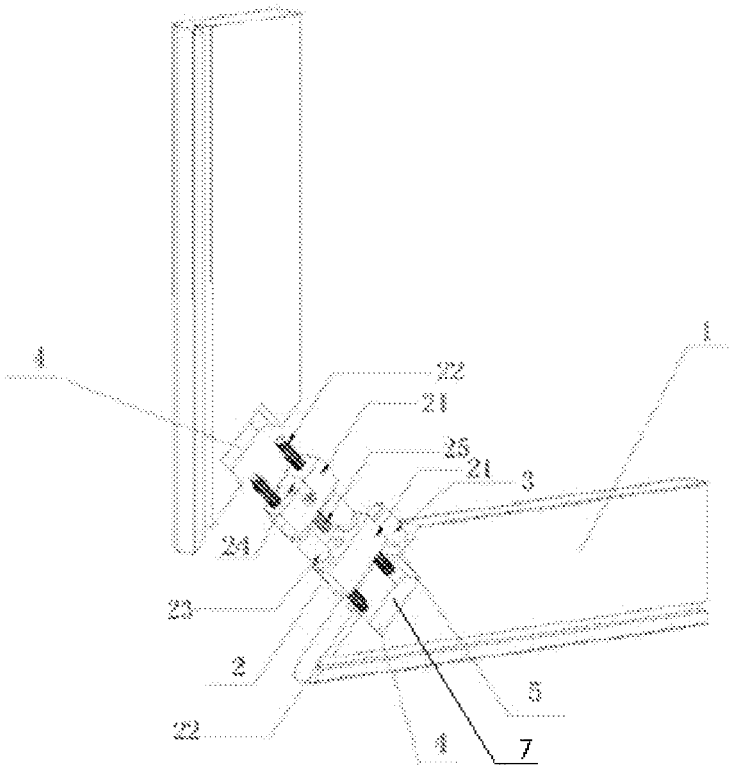
FIG. 1 is a schematic diagram of an inner structure of an embodiment of the disclosure.
Figure 2:
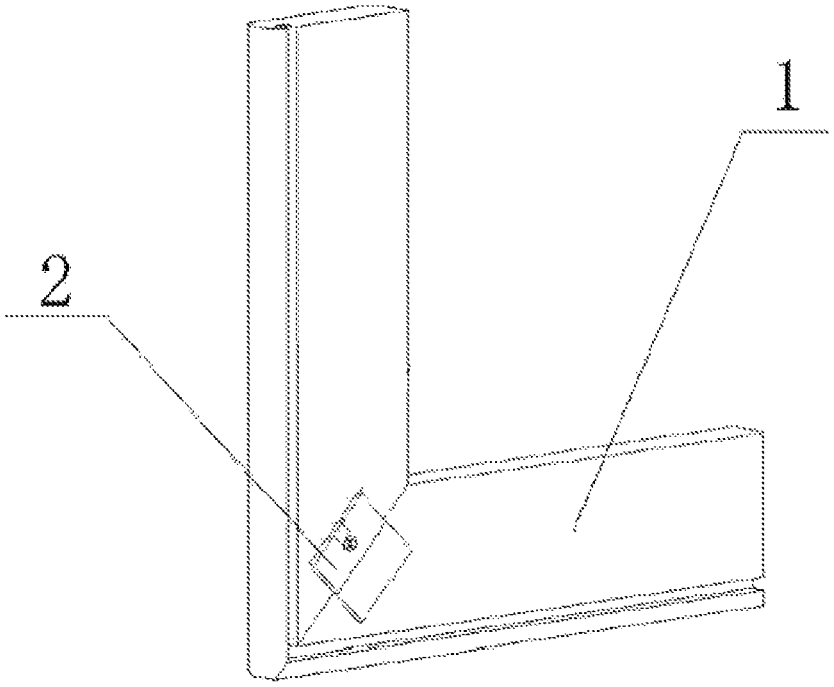
FIG. 2 is a structure diagram of an embodiment of the disclosure upon completion of installation.
Figure 3:
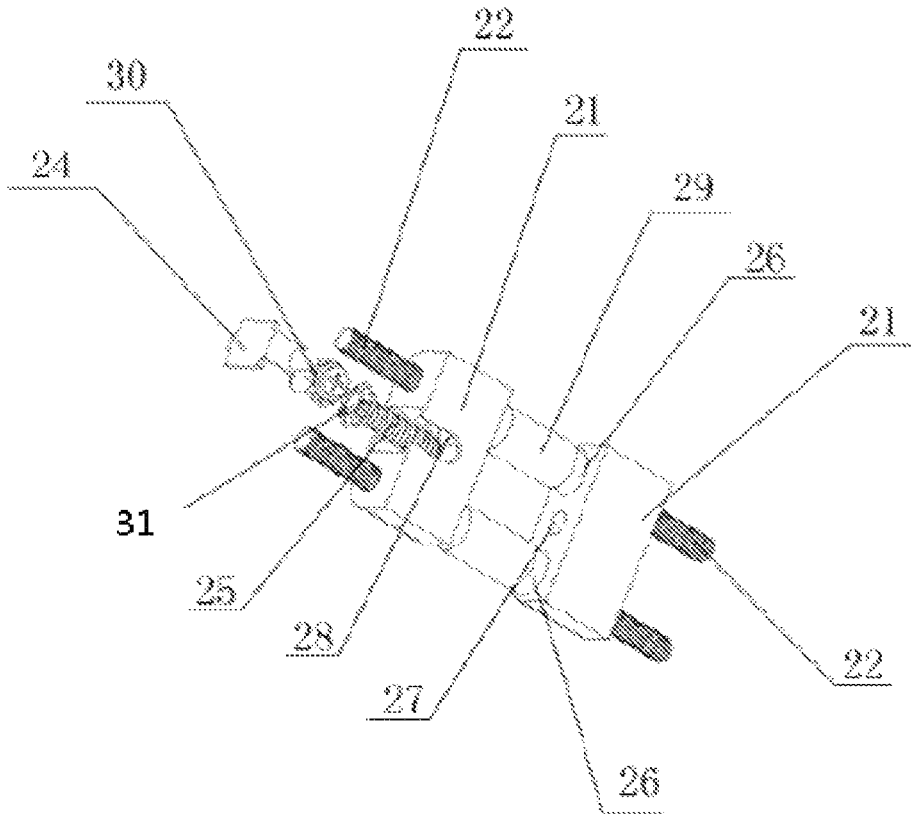
FIG. 3 is a structure diagram of an angle forming device of an embodiment of the disclosure.

The disclosure will be introduced in detail below in combination with the drawings: as shown in FIG. 1 to FIG. 3, a frame forming structure for use with a frame and a sash of an aluminium-wood combined door/window provided by the disclosure is characterized in that the door/window includes at least a door/window frame or a door/window sash frame. The door/window frame or the door/window sash frame is formed by two connecting adjacent profile frame strips 1 by means of an angle forming device 2 and a round tenon rod 3 on adjacent connecting end surfaces. The connecting end surfaces of two adjacent profile frame strips 1 are processed to have a section at an angle of 0-60° with respect to an end plane of a normal profile frame strip respectively, and are interconnected to form a perpendicular frame edge. Symmetric U-shaped notches 4 for positioning the angle forming device and symmetric round tenon rod holes 5 are processed on the connecting end surfaces of the two adjacent profile frame strips 1, respectively. A round tenon rod 3, which is used for positioning, is inserted into the symmetric round tenon rod holes 5. When the two adjacent profile frame strips 1 are mutually spliced, a space 7 which accommodates assembly-type the angle forming device 2 is formed at a splicing location. The assembly-type the angle forming device 2 is formed by combining two halves of the angle forming device 21 and each half of which is corresponding fixed in each of the U-shaped notches 4 of positioning adjacent profile frame strips with a bolt 22. The two halves of the angle forming device 21 are mechanically tightened by means of a bevel gear pair mechanism which is meshed through pairing, to tightly fix and connect two adjacent profile frame strips 1.

As shown in figures, the angle forming device 2 is formed by combining the two halves of the angle forming device 21, a positioning pin 29, a cover plate 24 and the bevel gear pair mechanism 25 of the angle forming device. The two halves of the angle forming device 21 are a fixing substrate having two fixing holes 26 and a gear hole 27. Herein, a side of one half of the angle forming device 21 is provided with a gear hole channel 28 and a cover plate 24 connecting with the one half of the angle forming device as well. The positioning pin 29 is a hollow cylindrical fastener, and both ends of the positioning pin 29 are connected into the fixing holes 26 which are arranged on opposite end surfaces of the two halves of the angle forming device 21, respectively. The bevel gear pair mechanism 25 of the angle forming device is formed by meshing a bevel gear 30 and a perpendicular bevel gear 31, the bevel gear is positioned between two positioning pins 29 and has a screw, and the perpendicular bevel gear 31 is perpendicularly arranged in the gear hole channel 28 and has a rotating head.

A layer of single-component glue is processed in the U-shaped notches 4 of two adjacent profile frame strips 1 of the disclosure, respectively. A bottom of each of the U-shaped notches 4 is provided with two pre-drilling holes, and the two halves of the angle forming device 21 are fixed in the U-shaped notches 4 when nailed through the two pre-drilling holes with the bolt 22, respectively. The connecting end surfaces of the two adjacent profile frame strips 1 are optimally processed into a section at an angle of 45° respectively, and each of the U-shaped notches 4 is positioned on a middle end surface of the section at an angle of 45°.

DETAILED DESCRIPTION OF THE EMBODIMENTS

The disclosure will be introduced in detail below in combination with the drawings: as shown in FIG. 1 to FIG. 3, a frame forming structure for use with a frame and a sash of an aluminium-wood combined door/window provided by the disclosure is characterized in that the door/window includes at least a door/window frame or a door/window sash frame. The door/window frame or the door/window sash frame is formed by two connecting adjacent profile frame strips 1 by means of an angle forming device 2 and a round tenon rod 3 on adjacent connecting end surfaces. The connecting end surfaces of two adjacent profile frame strips 1 are processed to have a section at an angle of 0-60° with respect to an end plane of a normal profile frame strip respectively, and are interconnected to form a perpendicular frame edge. Symmetric U-shaped notches 4 for positioning the angle forming device and symmetric round tenon rod holes 5 are processed on the connecting end surfaces of the two adjacent profile frame strips 1, respectively. A round tenon rod 3, which is used for positioning, is inserted into the symmetric round tenon rod holes 5. When the two adjacent profile frame strips 1 are mutually spliced, a space 7 which accommodates assembly-type the angle forming device 2 is formed at a splicing location. The assembly-type the angle forming device 2 is formed by combining two halves of the angle forming device 21 and each half of which is corresponding fixed in each of the U-shaped notches 4 of positioning adjacent profile frame strips with a bolt 22. The two halves of the angle forming device 21 are mechanically tightened by means of a bevel gear pair mechanism which is meshed through pairing, to tightly fix and connect two adjacent profile frame strips 1.

As shown in figures, the angle forming device 2 is formed by combining the two halves of the angle forming device 21, a positioning pin 29, a cover plate 24 and the bevel gear pair mechanism 25 of the angle forming device. The two halves of the angle forming device 21 are a fixing substrate having two fixing holes 26 and a gear hole 27. Herein, a side of one half of the angle forming device 21 is provided with a gear hole channel 28 and a cover plate 24 connecting with the one half of the angle forming device as well. The positioning pin 29 is a hollow cylindrical fastener, and both ends of the positioning pin 29 are connected into the fixing holes 26 which are arranged on opposite end surfaces of the two halves of the angle forming device 21, respectively. The bevel gear pair mechanism 25 of the angle forming device is formed by meshing a bevel gear 30 and a perpendicular bevel gear 31, the bevel gear is positioned between two positioning pins 29 and has a screw, and the perpendicular bevel gear 31 is perpendicularly arranged in the gear hole channel 28 and has a rotating head.

A layer of single-component glue is processed in the U-shaped notches 4 of two adjacent profile frame strips 1 of the disclosure, respectively. A bottom of each of the U-shaped notches 4 is provided with two pre-drilling holes, and the two halves of the angle forming device 21 are fixed in the U-shaped notches 4 when nailed through the two pre-drilling holes with the bolt 22, respectively. The connecting end surfaces of the two adjacent profile frame strips 1 are optimally processed into a section at an angle of 45° respectively, and each of the U-shaped notches 4 is positioned on a middle end surface of the section at an angle of 45°.

The disclosure positions with the round tenon rod and the positioning pin of the angle forming device and tightens with the bevel gear, thereby effectively ensuring connecting strength of an angle portion and sealing performance after angle formation and guaranteeing flatness. Furthermore, the disclosure has characteristics of increasing the connecting strength of the angle portion and the sealing performance after the angle formation, increasing convenience of frame formation, improving manufacturing efficiency, and the like.

INDUSTRIAL APPLICABILITY

The disclosure positions with a round tenon rod and a positioning pin of an angle forming device and tightens with a bevel gear, thereby effectively ensuring connecting strength of an angle portion and sealing performance after angle formation and guaranteeing flatness. Furthermore, the disclosure has characteristics of increasing the connecting strength of the angle portion and the sealing performance after the angle formation, increasing convenience of frame formation, improving manufacturing efficiency, and the like.

What is claimed is:

1. A frame and sash forming structure of an aluminium-wood combined door and window, comprising at least a frame for door and window or a sash frame for door and window, wherein the frame for door and window or the sash frame for door and window is formed by two connecting adjacent profile frame strips by means of an angle forming device and a round tenon rod on adjacent connecting end surfaces of the connecting adjacent profile frame strips; the connecting end surfaces of two adjacent profile frame strips are processed to have a section at an angle of 0-60° with respect to an end plane of a normal profile frame strip respectively, and are interconnected to form a perpendicular frame edge; symmetric U-shaped notches for positioning the angle forming device and symmetric round tenon rod holes are processed on the connecting end surfaces of the two adjacent profile frame strips, respectively; the round tenon rod, which is used for positioning, is inserted into the symmetric round tenon rod holes; when the two adjacent profile frame strips are mutually spliced, a space which accommodates the angle forming device is formed at a splicing location; the angle forming device is formed by combining two halves of the angle forming device, and each half of the two halves of the angle forming device is fixed in each of the corresponding U-shaped notches of the adjacent profile frame strips with a bolt; and the two halves of the angle forming device are mechanically tightened by means of a mechanism comprising a pair of meshed bevel gear, to fix and connect the two adjacent profile frame strips.

2. The frame and sash forming structure of an aluminium wood combined door and window as claimed in claim 1, wherein the angle forming device is formed by combining the two halves of the angle forming device, two positioning pins, a cover plate and the bevel gear pair mechanism of the angle forming device; the two halves of the angle forming device have two fixing holes and a gear hole, wherein a side of one half of the angle forming device is provided with one gear hole and a cover plate connecting with the one half of the angle forming device; each of the two positioning pins is a hollow cylindrical fastener, and both ends of each of the two positioning pins are connected into the fixing holes which are arranged on opposite end surfaces of the two halves of the angle forming device, respectively; the bevel gear pair mechanism of the angle forming device is formed by meshing a bevel gear and a perpendicular bevel gear, the bevel gear is positioned between the two positioning pins and has a screw, the perpendicular bevel gear is perpendicularly arranged in the gear hole and has a rotating head.

3. The frame and sash forming structure of an aluminium-wood combined door and window as claimed in claim 2, wherein a layer of single-component glue is processed in the U-shaped notches of the two adjacent profile frame strips, respectively; a bottom of each of the U-shaped notches is provided with two pre-drilled holes, and the two halves of the angle forming device are fixed in the U-shaped notches when nailed through the two pre-drilled holes with the bolt, respectively; the connecting end surfaces of the two adjacent profile frame strips are processed into a section at an angle of 45° respectively, and each of the U-shaped notches is positioned on a middle end surface of the section at an angle of 45°.

4. The frame and sash forming structure of an aluminium-wood combined door and window as claimed in claim 1, wherein a layer of single-component glue is processed in the U-shaped notches of the two adjacent profile frame strips, respectively; a bottom of each of the U-shaped notches is provided with two pre-drilled holes, and the two halves of the angle forming device are fixed in the U-shaped notches when nailed through the two pre-drilled holes with the bolt, respectively; the connecting end surfaces of the two adjacent profile frame strips are processed into a section at an angle of 45° respectively, and each of the U-shaped notches is positioned on a middle end surface of the section at an angle of 45°.

* * * * *